US007360260B2

(12) United States Patent
Gallawa et al.

(10) Patent No.: US 7,360,260 B2
(45) Date of Patent: Apr. 22, 2008

(54) FOOTBOARD SUPPORTING A STOWABLE BENCH

(75) Inventors: Mike Gallawa, Ridgefield, WA (US); Joel Grossman, Selangor (MY)

(73) Assignee: Night and Day Furniture LLC, Vancouver, WA (US)

( * ) Notice: Subject to any disclaimer, the term of this patent is extended or adjusted under 35 U.S.C. 154(b) by 0 days.

(21) Appl. No.: 11/152,183

(22) Filed: Jun. 15, 2005

(65) Prior Publication Data

US 2006/0282945 A1 Dec. 21, 2006

(51) Int. Cl.
*A47C 17/62* (2006.01)
*A47C 20/00* (2006.01)

(52) U.S. Cl. ..... 5/2.1; 5/53.1; 5/507.1; 108/134

(58) Field of Classification Search ..... 5/53.1, 5/507.1, 503.1, 2.1; 108/134, 115, 49, 42; 312/313, 314, 316
See application file for complete search history.

(56) References Cited

U.S. PATENT DOCUMENTS 330,721 A * 11/1885 McBlair ..... 108/179
713,529 A * 11/1902 Swindell, Sr. ..... 5/507.1
1,267,046 A * 5/1918 Beaird ..... 220/784
1,347,271 A * 7/1920 Hartman ..... 5/507.1
2,551,151 A * 5/1951 McMurtrie ..... 5/507.1
2,732,568 A * 1/1956 McMurtrie ..... 5/507.1
2,739,319 A * 3/1956 Keller ..... 5/617
2,870,459 A * 1/1959 Zabielski ..... 5/2.1
3,259,923 A * 7/1966 Batteram ..... 5/507.1
3,961,385 A * 6/1976 Ferry ..... 5/504.1
5,425,148 A * 6/1995 Ashcraft et al. ..... 5/507.1
6,721,968 B2 4/2004 Tolleson
7,036,160 B1 * 5/2006 Pecoraro ..... 5/2.1

* cited by examiner

*Primary Examiner*—Alexander Grosz
(74) *Attorney, Agent, or Firm*—Harness, Dickey & Pierce, P.L.C.

(57) ABSTRACT

A bed frame may include a footboard. The footboard may have two corner posts and at least one cross member that may extend between the corner posts. A platform may be pivotally coupled to the footboard for movement between a stowed position and an extended position. The platform may be pivotally coupled to the corner posts and/or the cross member. A support member may be pivotally coupled to the footboard for movement between a stowed position and an extended position in which the support member may support the platform.

18 Claims, 4 Drawing Sheets

FOOTBOARD SUPPORTING A STOWABLE BENCH

BACKGROUND

1. Field of the Invention

The present invention relates in general to bed frames, and more particularly to a footboard that may support a stowable bench.

2. Description of Related Art

Various types of bed frames are well known in the art. Some conventional bed frames may be combined with a table, a desk, and/or other furniture. However, none of the conventional bed frames include a footboard that may support a stowable bench.

SUMMARY

According to an example, non-limiting embodiment of the invention, a bed frame may include a footboard. A platform may be pivotally connected to the footboard.

According to another example, non-limiting embodiment of the invention, a footboard may include an assembly having two corner posts, and at least one cross member may extend between the two corner posts. A platform may be pivotally connected to the assembly.

BRIEF DESCRIPTION OF THE DRAWINGS

The present invention will become more fully understood from the detailed description below and the accompanying drawings, wherein like elements are represented by like reference numerals, which are given by way of illustration only and thus are not limiting of the present invention.

The drawings are provided for illustrative purposes only and are not drawn to scale. The spatial relationships and relative sizing of the elements illustrated in the various embodiments may have been reduced or expanded to improve the clarity of the figure with respect to the corresponding description. The figures, therefore, should not be interpreted as accurately reflecting the relative sizing of the corresponding structural elements that could be encompassed by an actual device manufactured according to the example, non-limiting embodiments of the invention.

DETAILED DESCRIPTION OF EXAMPLE, NON-LIMITING EMBODIMENTS

Example, non-limiting embodiments of the present invention will now be described more fully with reference to the accompanying drawings. This invention may, however, be embodied in many different forms and should not be construed as limited to the example embodiments set forth herein. The disclosed embodiments are provided so that this disclosure will be thorough and complete, and will fully convey the scope of the invention to those skilled in the art. The principles and features of this invention may be employed in varied and numerous embodiments without departing from the scope of the invention.

Well-known structures are not described or illustrated in detail to avoid obscuring the present invention.

Throughout this disclosure, the terms "horizontal" "vertical," "upper," "lower," "above" and "below" are used for convenience in describing various elements or portions or regions of the elements as shown in the figures. These terms do not, however, require that the structure be maintained in any particular orientation.

Figure 1:
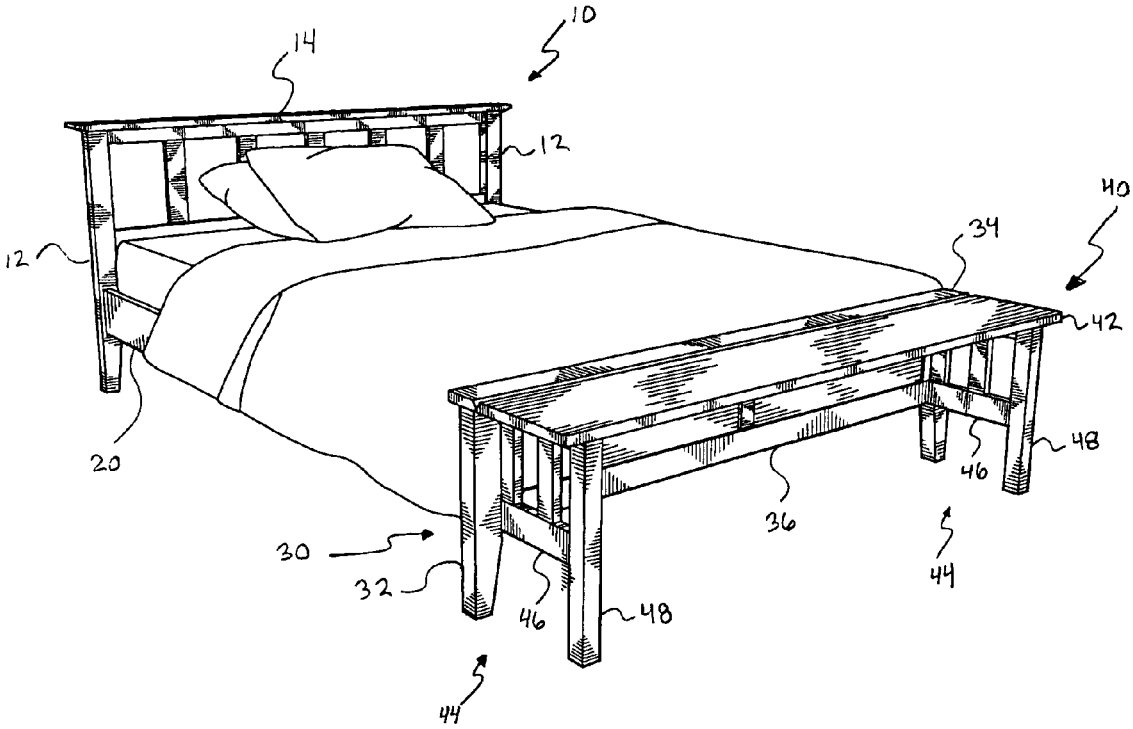
FIG. 1 is a perspective view of a footboard supporting a bench in an extended position according to an example, non-limiting embodiment of the invention.

A. Example Bed Frame:

With reference to FIG. 1, a bed frame may include a headboard 10, a pair of side rails 20 and a footboard 30.

The headboard 10 may include two corner posts 12. The corner posts 12 may be connected together by one or more cross members 14. The corner posts 12 and the cross member 14 may be mechanically held together by numerous and varied fasteners that are well known in this art.

The footboard 30 may include two corner posts 32. The corner posts 32 may be connected together by one or more cross members. In this example embodiment, the footboard 30 may include an upper cross member 34 and a lower cross member 36. By way of example only, the upper cross member 34 may extend across the end surfaces of the corner posts 32. In alternative embodiments, more or less than two cross members may be suitably implemented. The corner posts 32 and the cross members 34, 36 may be mechanically held together by numerous and varied fasteners that are well known in this art.

The side rails 20 may extend between the headboard 10 and the footboard 30. In this example embodiment, each of the side rails 20 may be connected to a corner post 12 of the headboard 10 and a corner post 32 of the footboard 30. The side rails 20, the headboard 10 and the footboard 30 may be mechanically held together by numerous and varied fasteners that are well known in this art.

B. Example Bench:

As shown in FIG. 1, the bench 40 may include a platform member 42 and a pair of support members 44.

Figure 2:
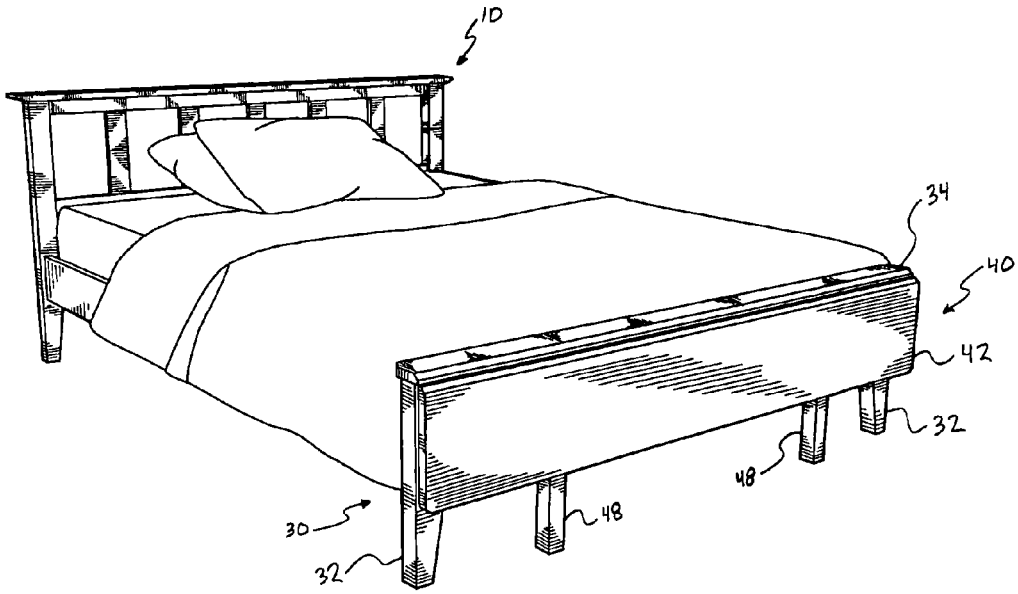
FIG. 2 is a perspective view of the footboard depicted in FIG. 1 supporting the bench in a stowed position.

The platform member 42 may be coupled to the footboard 30 for movement between an extended position (as shown in FIG. 1) and a stowed position (as shown in FIG. 2). In this example embodiment, the platform member 42 may be connected to the upper cross member 34. For example, a hinge (not shown) may be provided to pivotally connect together the platform member 42 and the upper cross member 34. The platform member 42 and the upper cross member 34 may be connected together by numerous other alternative fasteners that are well known in this art.

Each of the support members 44 may include a pivot arm 46 connected to an upright member 48. The support member 44 may be coupled to the footboard 30 for movement between an extended position (as shown in FIG. 1) and a stowed position (as shown in FIG. 2). In this example embodiment, the pivot arms 46 of the support members 44 may be respectively connected to the corner posts 32 of the footboard 30. For example, a hinge (not shown) may be provided to pivotally connect together the pivot arms 46 and the corner posts 32. The support members 44 and the corner posts 32 may be connected together by numerous other alternative fasteners that are well known in this art.

In the extended position shown in FIG. 1, the upright member 48 may have a lower end in contact with a floor, and an upper end supporting the platform member 42. Here, the platform member 42 may assume a horizontal or substantially horizontal orientation. Further, the platform member 42 and the upper cross member 34 may present a flush upper surface. In the stowed position shown in FIG. 2 (when the pivot arm 46 is pivoted relative to the corner post 32), the upright member 48 may be located below the upper cross member 34 so that the platform member 42 may pivot relative to the upper cross member 34. Here, the platform member 42 may assume a vertical or substantially vertical orientation. As best seen in FIG. 2, in the stowed position, the platform 42 lies substantially flat against the footboard and conceals at least a portion of at least one of its support members.

In this example embodiment, the platform member 42 may extend across the full width of the footboard 30. In alternative embodiments, the platform member 42 may extend only partially across or beyond the full width of the footboard 30. In this example embodiment, two support members 44 may be provided. In alternative embodiments, more or less than two support members 44 may be provided. In this example embodiment, the support members 44 may be pivotally connected to the corner posts 32 of the footboard 30. In alternative embodiments, the support members may be pivotally connected to other portions of the footboard 30. In this example embodiment, the pivot axes of the support members 44 may be perpendicular to the pivot axis of the platform member 42. In alternative embodiments, the pivot axes of the support members 44 may be inclined relative to (or parallel to) the pivot axis of the platform member 42.

Figure 3:
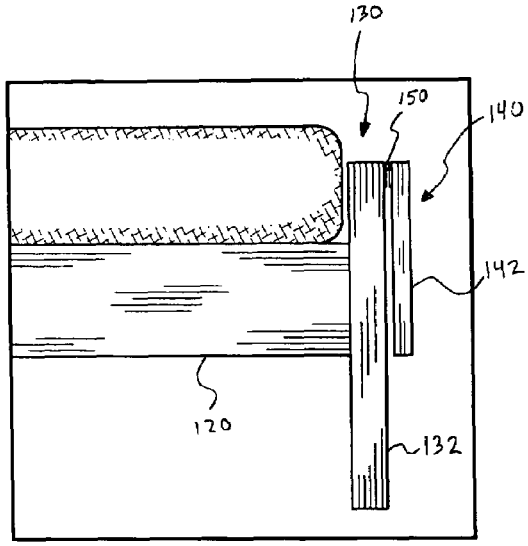
FIGS. 3 and 4 are partial elevational views of a footboard and a bench according to another example, non-limiting embodiment of the invention.
Figure 4:
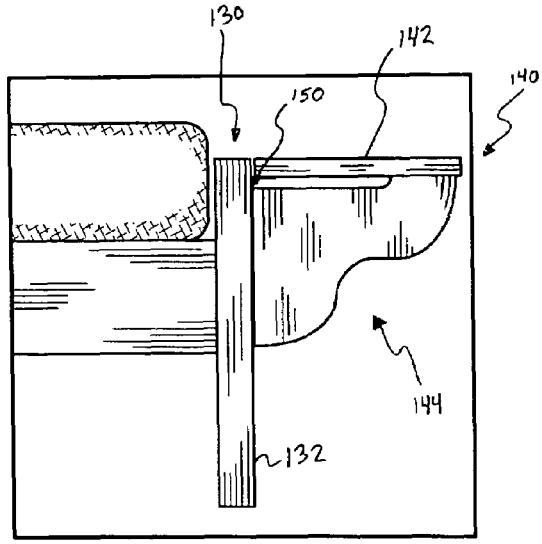

C. Example Modifications:

FIGS. 3 and 4 depict an example modification that may be somewhat structurally and functionally similar to the embodiment depicted in FIGS. 1 and 2, but there are some notable differences.

As shown in FIGS. 3 and 4, the footboard 130 need not include an upper cross member.

The bench 140 may include a platform member 142 and one or more support members 144. The platform member 142 may be coupled to the footboard 130 for movement between a stowed position (as shown in FIG. 3) and an extended position (as shown in FIG. 4). In this example embodiment, the platform member 142 may be connected to the corner post 132 of the footboard 130. For example, a hinge 150 may pivotally connect together the platform member 142 and the corner post 132. The platform member 142 and the corner post 132 may be connected together by numerous other alternative fasteners that are well known in this art.

The support member 144 may be in form of a brace. The support member 144 may be coupled to the footboard 130 for movement between a stowed position (as shown in FIG. 3) and an extended position (as shown in FIG. 4). In this example embodiment, the support member 144 may be connected to the corner posts 132 of the footboard 130. For example, a hinge (not shown) may be provided to pivotally connect together the support member 144 and the corner post 132. The support member 144 and the corner post 132 may be connected together by numerous other alternative fasteners that are well known in this art.

In the extended position shown in FIG. 4, the support member 144 may have an upper end supporting the platform member 142. Here, the platform member 142 may be supported in a horizontal or substantially horizontal fashion. Further, the platform member 142 and the corner post 132 may present a flush or substantially flush upper surface. In the stowed position shown in FIG. 3 (when the support member 144 is pivoted relative to the corner post 132), the support member 144 may be located between the corner posts 132 so that the platform member 142 may pivot relative to the corner post 132. Here, the platform member 142 may assume a vertical or substantially vertical orientation.

Figure 5:
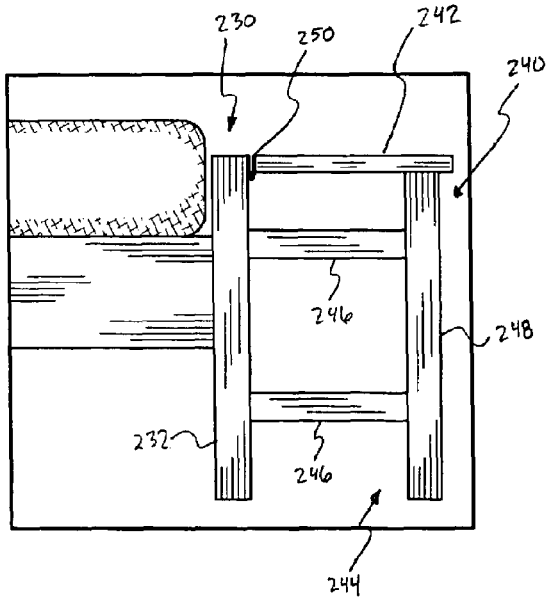
FIG. 5 is a partial elevational view a footboard and a bench according to another example, non-limiting embodiment of the invention.

FIG. 5 depicts another example modification. Here, the footboard 230 need not include an upper cross member.

The bench 240 may include a platform member 242 and one or more support members 244. The platform member 242 may be coupled to the footboard 230 for movement between a stowed position and an extended position (as shown in FIG. 5). In this example embodiment, the platform member 242 may be connected to the corner post 232 of the footboard 230 in a similar fashion as described above with respect to FIGS. 3 and 4. For example, the component parts may be coupled together via a hinge 250.

The support members 244 may be somewhat similar to the ones described above with respect to FIGS. 1 and 2. Here, however, each support member 244 may include two pivot arms 246 connected to an upright member 248.

Figure 6:
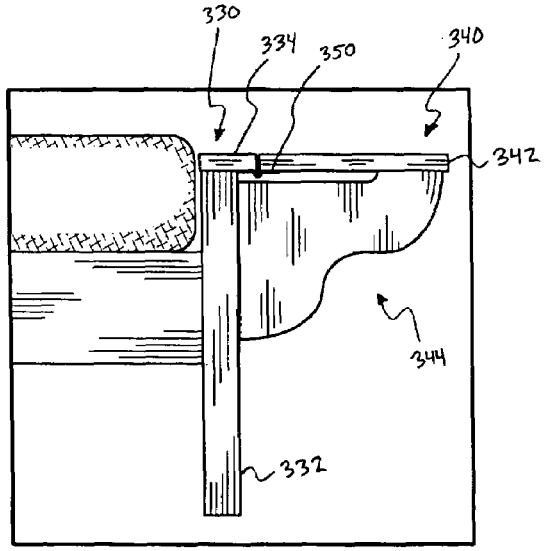
FIG. 6 is a partial elevational view a footboard and a bench according to another example, non-limiting embodiment of the invention.

FIG. 6 depicts another example modification. Here, the footboard 330 may include an upper cross member 334.

The bench 340 may include a platform member 342 and one or more support members 344. The platform member 342 may be coupled to the footboard 230 for movement between a stowed position and an extended position (as shown in FIG. 6). In this example embodiment, the platform member 342 may be connected to the upper cross member 334 of the footboard 330 in a similar fashion as described above with respect to FIGS. 1 and 2. For example, the component parts may be coupled together via a hinge 350.

The support members 344 may be similar to the ones described above with respect to FIGS. 3 and 4.

Figure 7:
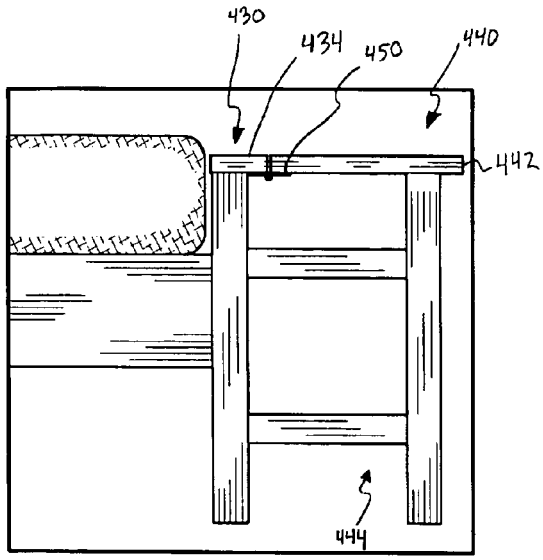
FIG. 7 is a partial elevational view a footboard and a bench according to another example, non-limiting embodiment of the invention.

FIG. 7 depicts another example modification. Here, the footboard 430 may include an upper cross member 434.

The bench 440 may include a platform member 442 and one or more support members 444. The platform member 442 may be similar to the one described above with respect to FIGS. 1 and 2. For example, the platform member 442 and the upper cross member 434 may be coupled together via a hinge 450.

The support members 444 may be somewhat similar to the ones described above with respect to FIG. 5.

Figure 8:
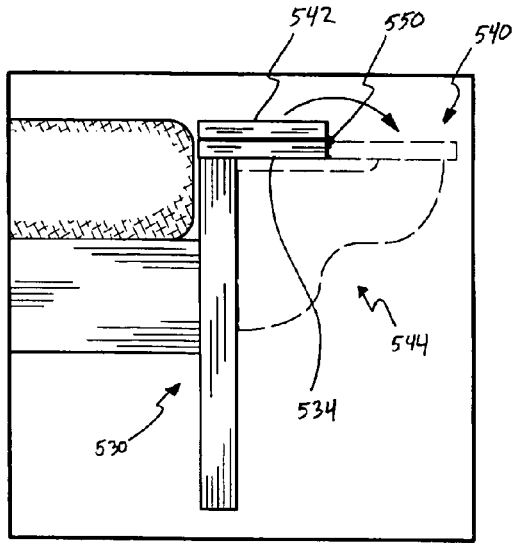
FIG. 8 is a partial elevational view a footboard and a bench according to another example, non-limiting embodiment of the invention.

FIG. 8 depicts another example modification. Here, the footboard 530 may include an upper cross member 534.

The bench 540 may include a platform member 542 and one or more support members 544. The platform member 542 may be coupled to the upper cross member 534 of the footboard 530 for movement between a stowed position (shown in solid lines) and an extended position (shown in phantom). The platform member 542 and the upper cross member 534 may coupled together via a hinge 550, for example.

In the stowed position, the platform member 542 may be superposed above (and rest upon) the upper cross member 534. In the stowed position, the platform member 542 may assume a horizontal or substantially horizontal orientation. In the extended position, the platform member 542 may be pivoted relative to the upper cross member 534 and supported by the support member 544. In the extended position, the platform member 542 may assume a horizontal or substantially horizontal orientation. Further, the platform member 542 and the upper cross member 534 may present a flush or substantially flush upper surface.

The support members 544 may be similar to the ones described above with respect to FIGS. 3 and 4.

Figure 9:
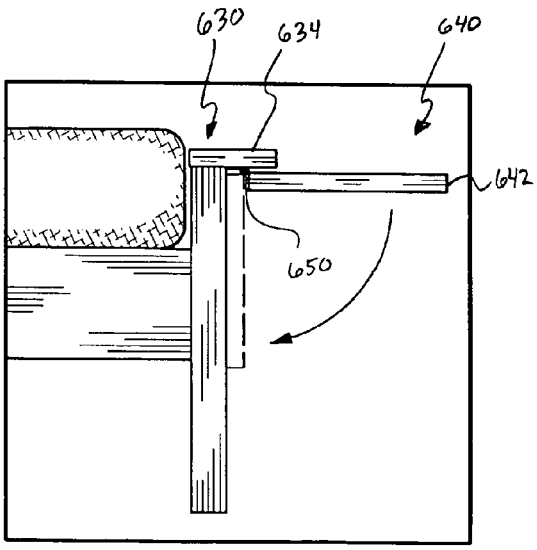
FIG. 9 is a partial elevational view a footboard and a bench according to another example, non-limiting embodiment of the invention.

FIG. 9 illustrates another example modification. Here, the footboard 630 may include an upper cross member 634.

The bench 640 may include a platform member 642. The platform member 642 may be pivotally connected to a lower surface of the upper cross member 634 using a hinge 650, for example.

In the extended position (shown in solid lines), the platform member 642 and the upper cross member 634 may not present a flush or substantially flush upper surface. In the stowed position (shown in phantom), the platform member 642 may be located below the upper cross member 634.

The bench 640 may also include support members (not shown). The support members may be similar to any of those previously described.

Figure 10:
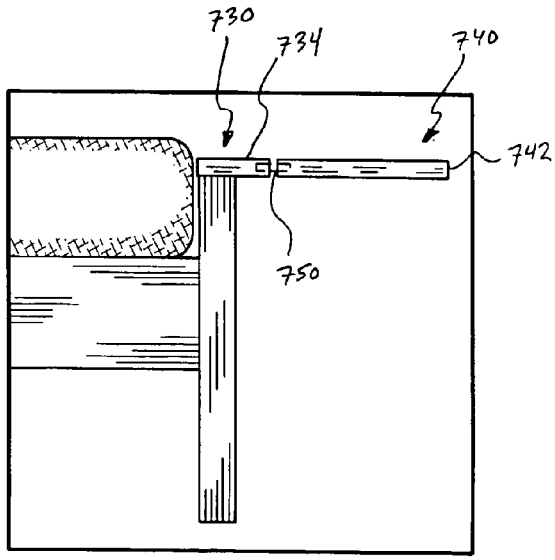
FIGS. 10 and 11 are partial elevational views a footboard and a bench according to another example, non-limiting embodiment of the invention.
Figure 11:
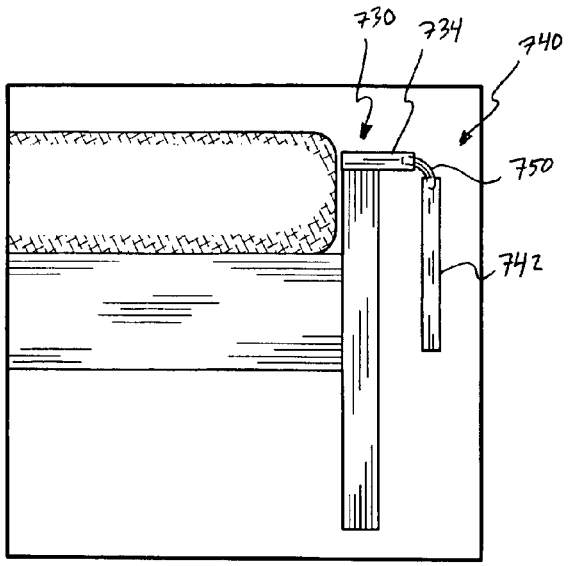

FIGS. 10 and 11 illustrate another example modification. Here, the footboard 730 may include an upper cross member 734.

The bench 740 may include a platform member 742. The platform member 742 may be pivotally connected to an end surface of the upper cross member 734 using a flexible member 750. The flexible member 750 may be in the form of a rope, a ribbon, an elastic member or numerous other flexible elements that are well known in this art.

In the extended position (shown in FIG. 10), the platform member 742 and the upper cross member 734 may present a flush or substantially flush upper surface. In the stowed position (shown in FIG. 11), the platform member 742 may hang in a vertical or substantially vertical orientation from the upper cross member 634.

The bench 740 may also include support members (not shown). The support members may be similar to any of those previously described.

Figure 12:
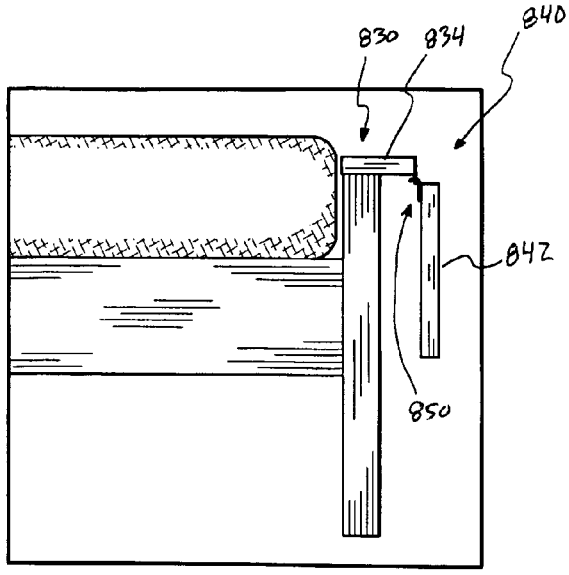
FIG. 12 is a partial elevational view a footboard and a bench according to another example, non-limiting embodiment of the invention.

FIG. 12 illustrates another example modification. Here, the footboard 830 may include an upper cross member 834.

The bench 840 may include a platform member 842. The platform member 842 may be pivotally connected to an end surface of the upper cross member 834 using a fastener 850. The fastener 850 may include a hook portion fixed to the platform member 842 and a receiving portion fixed to the upper cross member 834. In alternative embodiments, the hook portion may be fixed to the upper cross member 834 and the receiving portion may be fixed to the platform member 842. The fastener 850 may facilitate assembly and/or disassembly of the footboard 830 and the bench 840.

In the extended position (not shown), the platform member 842 and the upper cross member 834 may present a flush or substantially flush upper surface. In the stowed position (shown in FIG. 12), the platform member 842 may hang in a vertical or substantially vertical orientation from the upper cross member 834.

The bench 840 may also include support members (not shown). The support members may be similar to any of those previously described.

With respect to all of the disclosed embodiments, the component parts of the bed frame and the bench may be fabricated from numerous and alternative materials that are well known in this art.

The above example embodiments of the invention, including various and novel details of construction and combination of parts, have been particularly described with reference to the accompanying drawings. It will be understood that the bed frames, footboards and benches embodying the invention are shown by way of illustration only and not as a limitation. The principles and features of the disclosed embodiments may be employed in varied and numerous embodiments without departing from the scope of the invention, as defined by the appended claims.

For example, it will be readily apparent that the features of the various embodiments may be combined together. For example, a given bench may include a platform and more than one type of support member. Further, some features of a particular embodiment may be dispensed with in favor of features associated with other embodiments.

What is claimed is:

1. A bed frame comprising:

a footboard;

at least one support member pivotally coupled to the footboard having a substantially vertical pivot axis for movement of the at least one support member between a stowed position substantially flat against a cross member of the footboard and an extended position extending away from the cross member; and a platform pivotally connected to the footboard such that the platform is pivotable about a fixed pivot axis between an extended position and a stowed position substantially flat against the footboard and concealing at least a portion of the at least one support member positioned in the stowed position.

2. The bed frame of claim 1, wherein the platform is horizontally oriented in the extended position.

3. The bed frame of claim 1, wherein the platform is vertically oriented in the stowed position.

4. The bed frame of claim 1, wherein the platform is mounted on the footboard via at least one hinge.

5. The bed frame of claim 1, wherein the platform is mounted on the footboard via at least one flexible member.

6. The bed frame of claim 1, wherein, when in the extended position, the at least one support member supports the platform in the extended position.

7. The bed frame of claim 6, wherein the support member includes an upright member having an end surface that is flush with a lower end surface of the footboard.

8. The bed frame of claim 6, wherein the support member includes a brace having a lower end at an intermediate vertical position of the footboard.

9. The bed frame of claim 6, wherein a pivot axis of the platform is perpendicular to a pivot axis of the support member.

10. A footboard comprising:

an assembly including two corner posts; and at least one cross member extended between the two corner posts;

at least one support member pivotally coupled to the assembly having a substantially vertical pivot axis for movement of the at least one support member between a stowed position substantially flat against the at least one cross member and an extended position extending away from the at least one cross member; and a platform pivotally connected to the assembly such that the platform is pivotable about a fixed pivot axis between an extended position and a stowed position substantially flat against the assembly and concealing at least a portion of the at least one support member positioned in the stowed position.

11. The footboard of claim 10, wherein the platform is horizontally oriented in the extended position.

12. The footboard of claim 10, wherein the platform is vertically oriented in the stowed position.

13. The footboard of claim 10, wherein the platform is mounted on the assembly via at least one hinge.

14. The footboard of claim 10, wherein the platform is mounted on the assembly via at least one flexible member.

15. The footboard of claim 10, wherein, when in the extended position, the at least one support member supports the platform in the extended position.

16. The footboard of claim 10, wherein the platform is pivotally connected to at least one of the corner posts.

17. The footboard of claim 10, wherein the platform is pivotally connected to the at least one cross member.

18. A method comprising:

providing a footboard;

pivotally connecting at least one support member to the footboard such that the at least one support member has a substantially vertical pivot axis for moving the at least one support member between a stowed position substantially flat against at least one cross member of the footboard and an extended position extending away from the at least one cross member; and pivotally connecting a platform to the footboard such that the platform is pivotable about a fixed pivot axis between an extended position and a stowed position substantially flat against the footboard and concealing at least a portion of the at least one support member positioned in the stowed position.

* * * * *